US008018308B2

(12) United States Patent
Kwon et al.

(10) Patent No.: US 8,018,308 B2
(45) Date of Patent: Sep. 13, 2011

(54) DOWNWARD TYPE MEMS SWITCH AND METHOD FOR FABRICATING THE SAME

(75) Inventors: Sang-wook Kwon, Seongnam-si (KR); Jong-seok Kim, Hwaseong-si (KR); In-sang Song, Seoul (KR); Sang-hun Lee, Seoul (KR); Dong-kyun Kim, Suwon-si (KR); Jung-han Choi, Yongin-si (KR); Young-tack Houng, Suwon-si (KR); Che-heung Kim, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1331 days.

(21) Appl. No.: 11/581,435

(22) Filed: Oct. 17, 2006

(65) Prior Publication Data

US 2007/0195464 A1 Aug. 23, 2007

(30) Foreign Application Priority Data

Feb. 20, 2006 (KR) ..... 10-2006-0016308

(51) Int. Cl.
*H01H 51/22* (2006.01)

(52) U.S. Cl. ..... 335/78; 200/181
(58) Field of Classification Search ..... 335/78; 200/181
See application file for complete search history.

(56) References Cited

U.S. PATENT DOCUMENTS

| | | | | |
|---|---|---|---|---|
| 6,127,744 | A * | 10/2000 | Streeter et al. | 307/125 |
| 6,191,671 | B1 * | 2/2001 | Schlaak et al. | 335/78 |
| 6,483,395 | B2 * | 11/2002 | Kasai et al. | 333/105 |
| 6,700,309 | B2 * | 3/2004 | Dausch et al. | 310/330 |
| 7,109,641 | B2 | 9/2006 | Park | |
| 7,312,677 | B2 * | 12/2007 | Nakatani et al. | 335/78 |
| 7,342,472 | B2 * | 3/2008 | Charvet | 335/78 |
| 7,414,500 | B2 * | 8/2008 | De Los Santos | 335/78 |
| 7,535,326 | B2 * | 5/2009 | Nakatani et al. | 335/78 |
| 7,545,246 | B2 * | 6/2009 | Kim et al. | 335/78 |
| 7,585,113 | B2 * | 9/2009 | Lee et al. | 384/147 |
| 2002/0140533 | A1 * | 10/2002 | Miyazaki et al. | 335/78 |
| 2007/0278075 | A1 * | 12/2007 | Terano et al. | 200/181 |

FOREIGN PATENT DOCUMENTS

| | | | |
|---|---|---|---|
| JP | H57-115735 | A | 7/1982 |
| JP | 2004-327441 | A | 11/2004 |

* cited by examiner

*Primary Examiner* — Anh T Mai
*Assistant Examiner* — Bernard Rojas
(74) *Attorney, Agent, or Firm* — Sughrue Mion, PLLC

(57) ABSTRACT

A downward type micro electro mechanical system (EMS) switch and a method of fabricating the same is provided. The downward type MEMS switch includes first and second cavities formed in a substrate, first and second actuators formed on upper portions of the first and second cavities, first and second fixing lines formed on an upper surface of the substrate and not overlapped with the first and second cavities, and a contact pad which is spaced apart at a predetermined distance from surfaces of the first fixing line and the second fixing line but which can be contacted with the first fixing line and the second fixing line when the first actuator and the second actuator are driven. The contact pad, which is actuated downward by piezoelectricity, is fabricated as it shares a layer with a RF signal line, after the RF signal line is fabricated.

12 Claims, 8 Drawing Sheets

DOWNWARD TYPE MEMS SWITCH AND METHOD FOR FABRICATING THE SAME

CROSS-REFERENCE TO RELATED APPLICATIONS

This application claims priority from Korean Patent Application No. 10-2006-16308 filed on Feb. 20, 2006, in the Korean Intellectual Property Office, the disclosure of which is incorporated herein by reference in its entirety.

BACKGROUND OF THE INVENTION

1. Field of the Invention

An aspect of the present invention relates to a downward type micro electro mechanical system (MEMS) switch and a method for fabricating the same. More particularly, an aspect of the present invention relates to a downward type MEMS switch and a method for fabricating the same in which a contact pad, which is actuated downward by piezoelectricity, is produced to share a layer with a radio frequency (RF) signal line, after forming a RF signal line.

2. Description of the Related Art

A reconfigurable antenna changes the characteristic of antenna such as center frequency, bandwidth, and gain according to a mechanical or electrical method, and recently, it applies to fabrication of a multi band antenna. If the multi band antenna is applied to a mobile communication device, the mobile communication device should include a switch to divide signals of a frequency bandwidth.

Switches for a conventional reconfigurable multi band antenna include a semiconductor switch, an electrostatic actuation switch, which is actuated by electrostatic force, and a cantilever switch.

In the case of a semiconductor switch, it is difficult to integrally fabricate the semiconductor switch and the antenna on an identical substrate since there occur problems related to fabrication compatibility between the semiconductor switch and an antenna.

An electrostatic actuation switch is generally fabricated by micro electro mechanical system (MEMS) technology and accordingly, a part of the substrate employs a metal. Therefore, electro magnetic coupling phenomenon may probably occur between the metal of the antenna and the metal of the substrate. Thus, there is a limit to the increase in performance, fabrication and design, and there is also a limit to miniaturization and low voltage actuation.

In the case of a cantilever switch, which is mainly used in a piezoelectric scheme, initial displacement may easily occur due to a stress generated when a multi layer is fabricated, and the initial displacement restricts accurate switching controls.

The cantilever switch has a driving layer at one side and accordingly, has less driving force than MEMS switch that drives at both sides so that the cantilever switch has insufficient contact force. Additionally, the driving force of the cantilever switch is reduced due to its unsymmetrical structure.

Additionally, in the case of a conventional MEMS switch driving at both sides, a contact metal contacting an antenna line is formed before an actuator is fabricated so that a coupling phenomenon increases.

SUMMARY OF THE INVENTION

The present invention has been conceived to solve the above-mentioned problems occurring in the prior art, and an aspect of the present invention is to provide a downward type MEMS switch and a method for fabricating the same that forms a metal of a substrate, which is connected to a radio frequency (RF) line by piezoelectricity, after forming an actuator and an antenna line, which actuate a switch, so that the above disadvantages of conventional art can be solved.

In order to achieve the above aspects, there is provided a method of fabricating a downward type micro electro mechanical system (MEMS) switch including operations of (a) forming a first cavity and a second cavity in a substrate, (b) forming a first actuator and a second actuator on each upper portion of the first cavity and the second cavity, (c) forming a first fixing line and a second fixing line on an upper surface of the substrate not to be overlapped with the first cavity and the second cavity, and (d) forming a contact pad which is spaced apart at a predetermined distance from surfaces of the first fixing line and the second fixing line but can be contacted with the first fixing line and the second fixing line when the first actuator and the second actuator are driven.

The method may further include operation (e) forming a supporting layer which is spaced apart at a predetermined distance from a top surface of the contact pad to be connected to each one end of the first actuator and the second actuator.

If power is applied, the contact pad is actuated downward by piezoelectricity generated from the first actuator and the second actuator so as to be connected to at least one of the first fixing line and the second fixing line.

The first fixing line and the second fixing line may be antenna signal lines of different bandwidths.

The contact pad may be depressed at a certain area, and may protrude at opposite upper ends of the certain area so as to be connected to each of the first fixing line and the second fixing line.

The operation (b) may include operations of (b1) forming a lower electrode on the substrate to cover the first cavity and the second cavity, (b2) forming a piezo layer, consisting of piezo ceramic, on the lower electrode, (b3) forming an upper electrode on the piezo layer, and (b4) forming a membrane layer on the upper electrode.

In order to achieve the above aspects, there is provided a downward type MEMS switch including a substrate in which a first cavity and a second cavity are formed, a first fixing line and a second fixing line which are formed on an upper surface of the substrate not to be crossed with the first cavity and the second cavity, a contact pad which is spaced apart at a predetermined distance from surfaces of the first fixing line and the second fixing line, and a first actuator and a second actuator which are disposed on each upper portion of the first cavity and the second cavity and downward actuate the contact pad to be in contact with at least one of the first fixing line and the second fixing line when power is supplied. The contact pad is formed after the first actuator, the second actuator, the first fixing line, and the second fixing line are formed.

The downward type MEMS switch may further include a supporting layer which is spaced apart at a predetermined distance from a surface of the contact pad to be connected to each one end of the first actuator and the second actuator.

The first fixing line and the second fixing line may be antenna signal lines of different bandwidths.

The contact pad may be depressed at a certain area, and may protrude at opposite upper ends of the certain area so as to be connected to each of the first fixing line and the second fixing line.

The first actuator and the second actuator each may include a lower electrode which is disposed on the substrate to cover the first cavity and the second cavity, a piezo layer which is disposed on the lower electrode and consists of piezo ceramic, an upper electrode which is disposed on the piezo layer, and a membrane layer which is disposed on the upper electrode.

BRIEF DESCRIPTION OF THE DRAWINGS

The above and other aspects, features and advantages of the present invention will be more apparent from the following detailed description taken with reference to the accompanying drawings, in which.

DETAILED DESCRIPTION OF THE EXEMPLARY EMBODIMENTS

Figure 1:
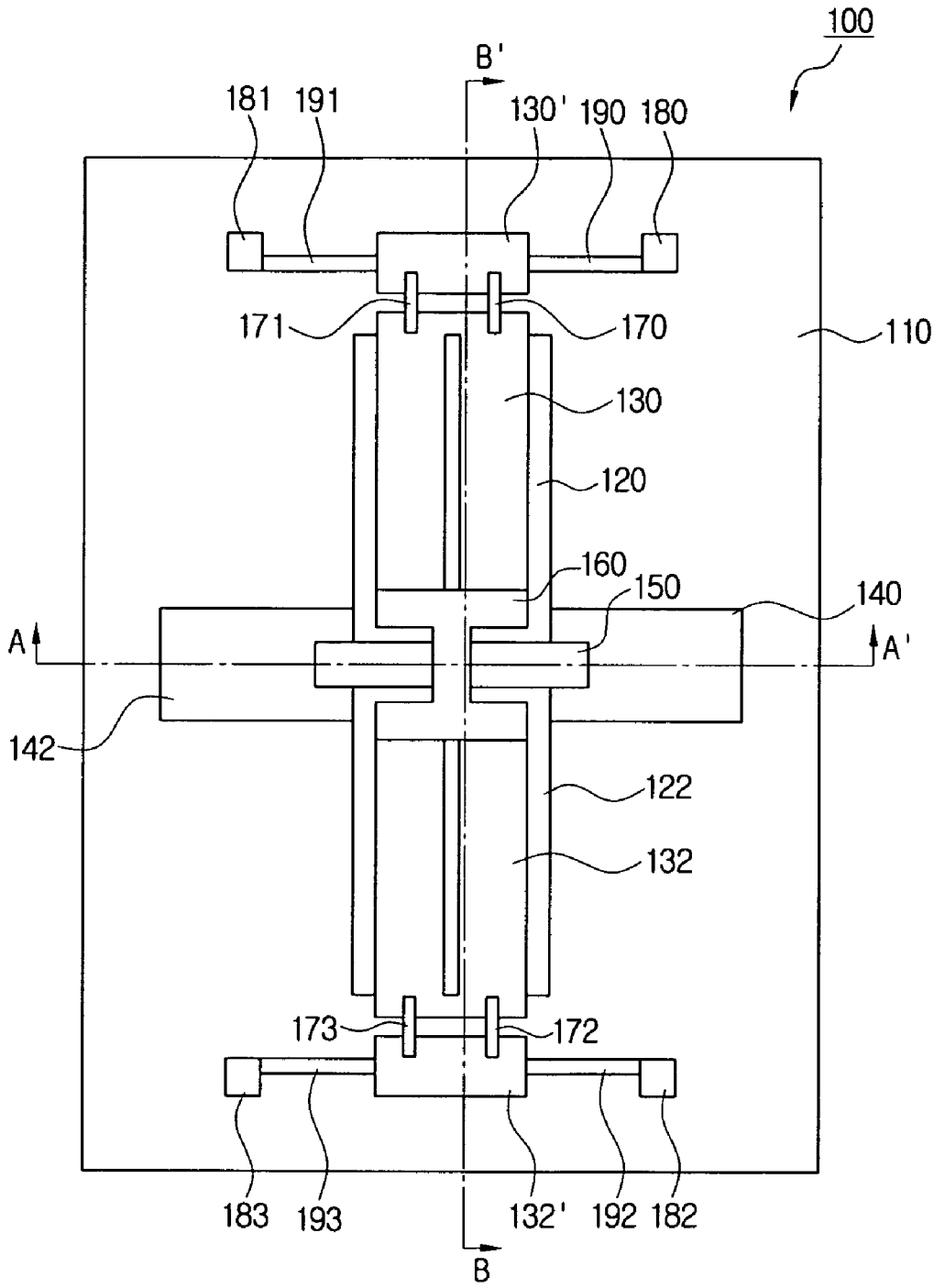
FIG. 1 is a view illustrating a downward type MEMS switch according to an exemplary embodiment of the present invention.

Exemplary embodiments of the present invention will be described in detail with reference to the annexed drawings. In the drawings, the same elements are denoted by the same reference numerals throughout the drawings. In the following description, detailed descriptions of known functions and configurations incorporated herein have been omitted for conciseness and clarity.

Figure 2:
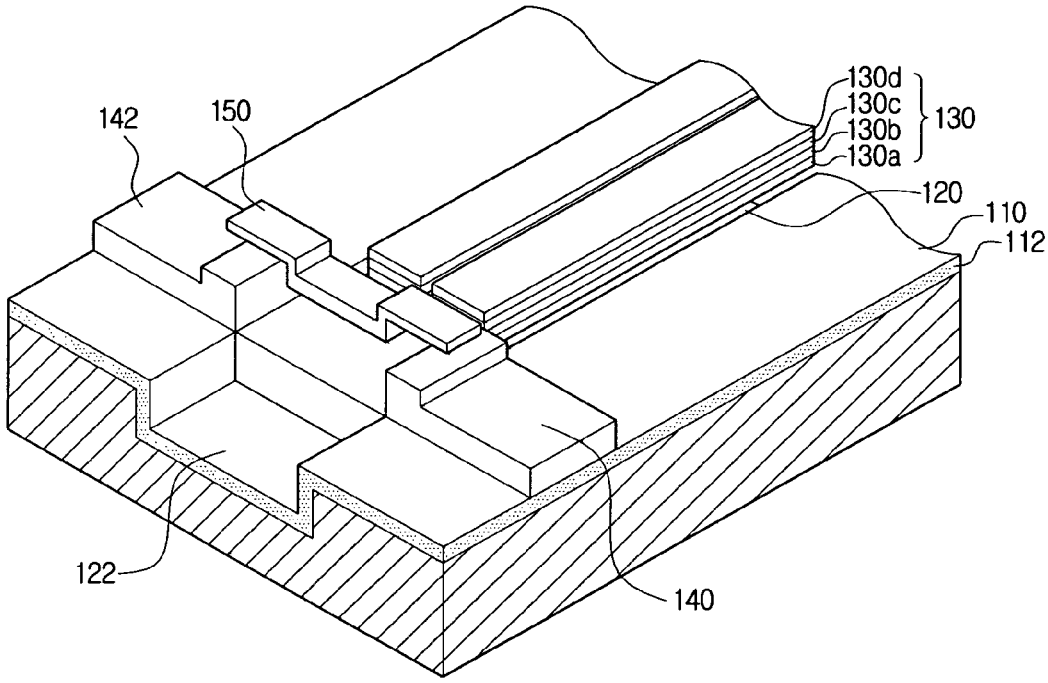
FIG. 2 is a perspective view of a part of the downward type MEMS switch illustrated in FIG. 1, from which a supporting layer is removed.
Figure 3:
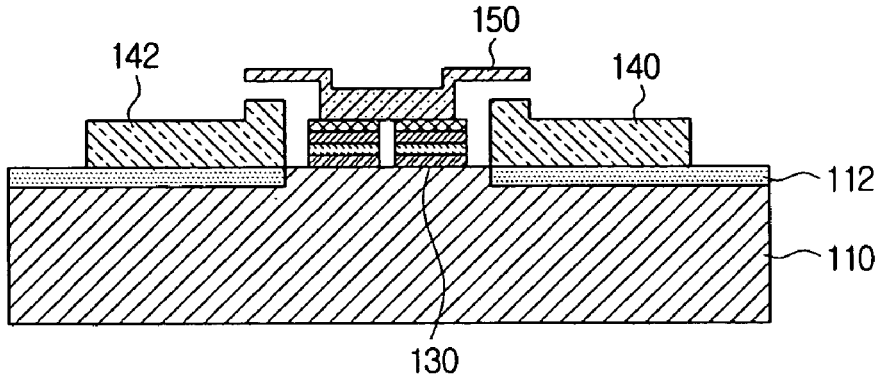
FIG. 3 is a cross-sectional view of a downward type MEMS switch taken on line A-A' of FIG. 1, from which a supporting layer is removed.
Figure 4:
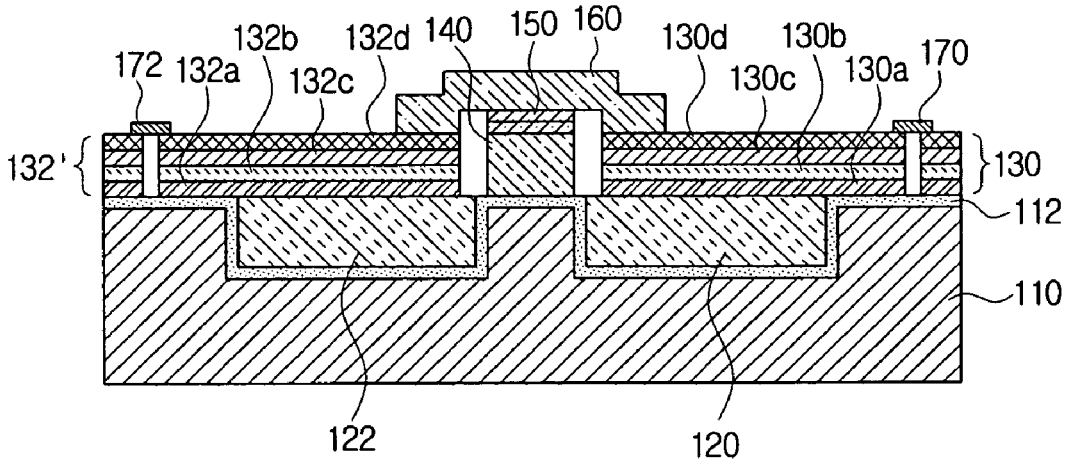
FIG. 4 is a cross-sectional view of a downward type MEMS switch taken on line B-B' of FIG. 1.

FIG. 1 is a view illustrating a downward type MEMS switch according to an exemplary embodiment of the present invention, FIG. 2 is a perspective view of a part of the downward type MEMS switch illustrated in FIG. 1, from which a supporting layer is removed, FIG. 3 is a cross-sectional view of a downward type MEMS switch taken on line A-A' of FIG. 1, from which a supporting layer is removed, and FIG. 4 is a cross-sectional view of a downward type MEMS switch taken on line B-B' of FIG. 1.

Referring to FIGS. 1 through 4, the downward type MEMS switch 100 includes a substrate 110 in which first and second cavities 120, 122 are formed, a first actuator 130, a second actuator 132, a first fixing line 140, a second fixing line 142, a contact pad 150, and a supporting layer 160, and the downward type MEMS switch 100 is driven according to piezoelectric scheme, which will be explained later.

The first cavity 120 and the second cavity 122 are symmetrically formed in a first area and a second area, respectively, of the substrate 110 and spaced apart from each other at a predetermined distance.

The first actuator 130 and the second actuator 132 are formed on upper portions of the first cavity 120 and the second cavity 122, respectively, and have ends fixed on one end of the substrate 110.

In FIG. 1, ends of the first actuator 130 and the second actuator 132, which are adjacent to a first sub actuator 130' and a second sub actuator 132', are fixed on the substrate 110. If power is applied, the fist actuator 130 and the second actuator 132 actuate the contact pad 150 to move downwardly using piezoelectricity so that the contact pad 150 comes into contact with at least one of the first fixing line 140 and the second fixing line 142 to transmit RF signals.

To do so, the first actuator 130 includes a first lower electrode 130*a*, a first piezoelectric layer 130*b*, a first upper electrode 130*c*, and a first membrane layer 130*d*, and a second actuator 132 includes a second lower electrode 132*a*, a second piezoelectric layer 132*b*, a second upper electrode 132*c*, and a second membrane layer 132*d*.

The first lower electrode 130*a* and the second lower electrode 132*a* are formed on the substrate 110 to cover the first cavity 120 and the second cavity 122.

The first piezoelectric layer 130*b* and the second piezoelectric layer 132*b* are formed on the first lower electrode 130*a* and the second lower electrode 132*a*, respectively, and are made of piezo ceramic. The piezo ceramic is a piezoelectric layer, which is produced through a ceramic fabrication using PbO, ZrO2, and TiO2, and also calls PZT.

The first upper electrode 130*c* and the second upper electrode 132*c* are formed on the first piezoelectric layer 130*b* and the second piezoelectric layer 132*b*, respectively, and the first membrane layer 130*d* and the second membrane layer 132*d* are formed on the first piezoelectric layer 130*b* and the second piezoelectric layer 132*b*, respectively.

The first lower electrode 130*a* and the first upper electrode 130*c* are connected to the first sub actuator 130' by an upper terminal 170 and a lower terminal 171, respectively, and a first electrode pad 180 and a first ground pad 181 are connected to the first sub actuator 130' by driving lines 190 and 191, respectively.

The second actuator 132 includes the second lower electrode 132*a*, the second piezoelectric layer 132*b*, the second upper electrode 132*c*, and the second membrane layer 132*d*, which correspond to the structure of the first actuator 130. Accordingly, the detailed description thereof will be omitted for the sake of brevity. However, the second lower electrode 132*a* and the second upper electrode 132*b* are connected to the second sub actuator 132' by the upper terminal 172 and the lower terminal 173, respectively, and a second electrode pad 182 and a second ground pad 183 are connected to the second sub actuator 132' by driving lines 192 and 193, respectively.

The first fixing line 140 and the second fixing line 142 are formed on the substrate 110 so as not to be crossed with the first cavity 120 and the second cavity 122, and each end thereof protrudes. Due to the protruding structure, the contact pad 150 can be more accurately connected to at least one of the first fixing line 140 and the second fixing line 142 when the contact pad 150 is actuated downwardly. In the present exemplary embodiment, the first fixing line 140 and the second fixing line 142 employ antenna signal lines with different bandwidths to apply to a reconfigurable antenna. Additionally, the first fixing line 140 and the second fixing line 142 employ a coplanar wave guide (CPW) line, which has a signal line and a ground at one surface.

The contact pad 150 is spaced apart at a predetermined distance from surfaces of the first fixing line 140 and the second fixing line 142. The contact pad 150 is configured as a hexahedron or a regular hexahedron so as to be connected to the first fixing line 140 and the second fixing line 142.

In the present exemplary embodiment, the contact pad 150 is depressed at a certain area, and protrudes at opposite upper ends of the certain area so as to be connected to each of the first fixing line 140 and the second fixing line 142 as shown in FIG. 2. Accordingly, when the contact pad 150 is actuated downward, protruding portions of the first fixing line 140 and the second fixing line 142 are in contact with the both protruding ends of the contact pad 150 so as to be switched on. However, this should not be considered as limiting. The protruding configuration is a mere example of the contact pad 150.

The first fixing line 140, the second fixing line 142, and the contact pad 150 may be made of a metal material such as Aurum, and the contact pad 150 is formed after the first actuator 130, the second actuator 132, the first fixing line 140, and the second fixing line 142 are fabricated. This can solve a coupling phenomenon which can occur between the contact pad 150 and the first actuator 130 and the second actuator 132, or between the contact pad 150 and the first fixing line 140 and the second fixing line 142 in the MEMS switch 100.

The supporting layer 160 prevents the contact pad 150 from moving upwardly or being separated if piezoelectricity is generated when power is applied to the first and the second actuators 130, 132. To this end, both ends of the supporting layer 160 are connected to each one end of the first membrane layer 130*d* and the second membrane layer 132*d*, and the supporting layer 160 is spaced apart from the depressed surface or the entire surface of the contact pad 150. Top surfaces of the protruding portions of the contact pad 150 are in contact with the supporting layer 160 so as to prevent the contact pad 150 from moving upwardly.

FIGS. 5A through 5F are views for explaining a method of fabricating the downward type MEMS switch illustrated in FIG. 1.

Figure 5A:
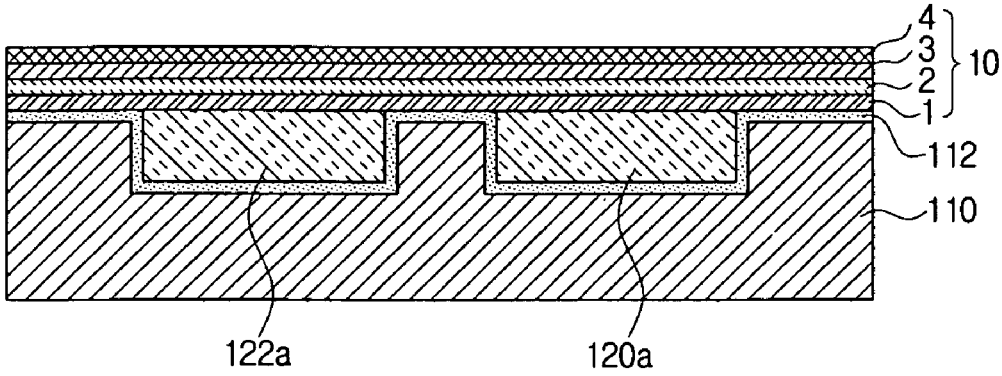
FIGS. 5A through 5F are views for explaining a fabrication method of a downward type MEMS switch illustrated in FIG. 1.

Referring to FIG. 5A, the first cavity 120 and the second cavity 122 are formed by etching, and then a passivation layer 112 and first and second sacrificial layers 120*a* and 122*a* are deposited on the surface of the substrate 110.

The first and the second sacrificial layers 120*a* and 122*a* are coated and patterned by poly register, and then are polished by a poly chemical mechanical polishing (CMP). The first and second sacrificial layers 120*a* and 122*a* may comprise Poly Si, PR polymer, and metal, and are spaced apart from each other at a predetermined distance. A lower electrode 1, a piezoelectric layer 2, an upper electrode 3, and a membrane layer 4 are sequentially deposited on the substrate 110 including the first and the second sacrificial layers 120*a* and 122*a* so as to form an actuator 10.

Figure 5B:
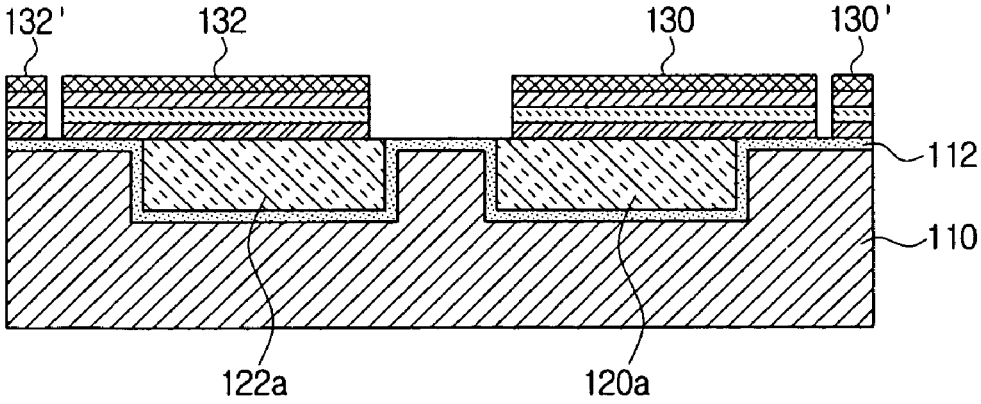

As shown in FIG. 5B, the actuator 10 is patterned to form the first actuator 130, the second actuator 132, the first sub actuator 130', and the second sub actuator 132'. Here, the first sub actuator 130' and the second sub actuator 132' are formed on areas of the substrate 110 in which the first sacrificial layer 120*a* and the second sacrificial layer 122*a* are not formed.

Figure 5C:
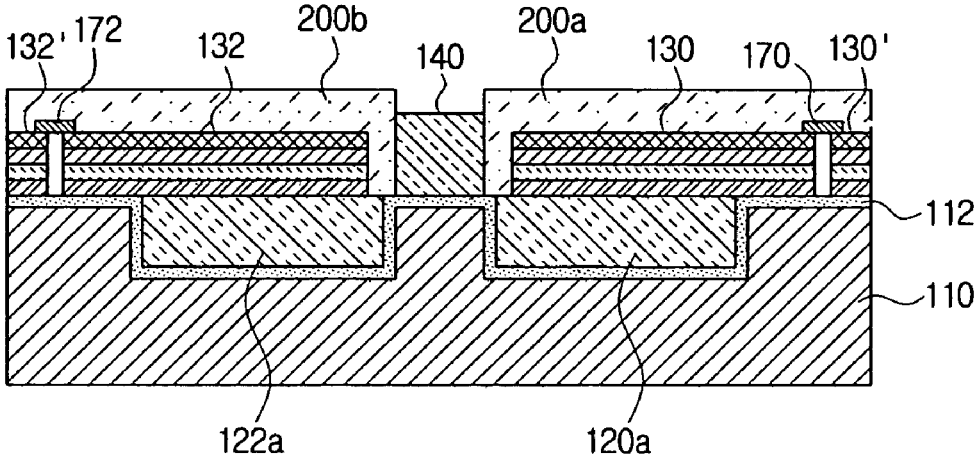

As shown in FIG. 5C, the first fixing line 140 is formed on the substrate 110 on which the first actuator 130 and the second actuator 132 are formed. The second fixing line 142 is also formed on the substrate 110, but is not shown in FIG. 5C. The first fixing line 140 and the second fixing line 142 are generally configured as CPW lines, and comprise contact metal such as Au. The first fixing line 140 and the second fixing line 142 each have one protruding end, so they are located in higher positions than the first actuator 130 and the second actuator 132 in cross-section taken along line B-B' of FIG. 1.

The upper terminals 170, 172 and the lower terminals 171, 173 are formed as power supply passages between the first actuator 130 and the first sub actuator 130', and between the second actuator 132 and the second sub actuator 132'. A third sacrificial layer 200*a*, a fourth sacrificial layer 200*b*, and a seed layer (not shown) are deposited, and then plating molding is performed to form the contact pad 150. In this process, intervals between the contact pad 150 and the first fixing line 140 and the second fixing line 142 can be varied depending on thickness of the third sacrificial layer 200*a* and the fourth sacrificial layer 200*b*.

Figure 5D:
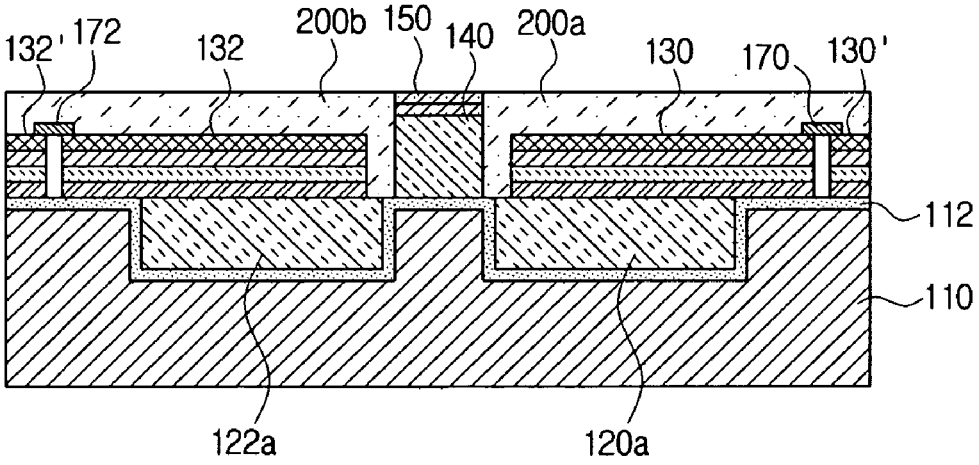

As shown in FIG. 5D, the contact pad 150 is formed on the plate-molded area by electroplating. The opposite ends of the contact pad 150 protrude so as to be in contact with one end of each of the first fixing line 140 and the second fixing line 142 if the contact pad 150 is actuated downwardly.

Figure 5E:
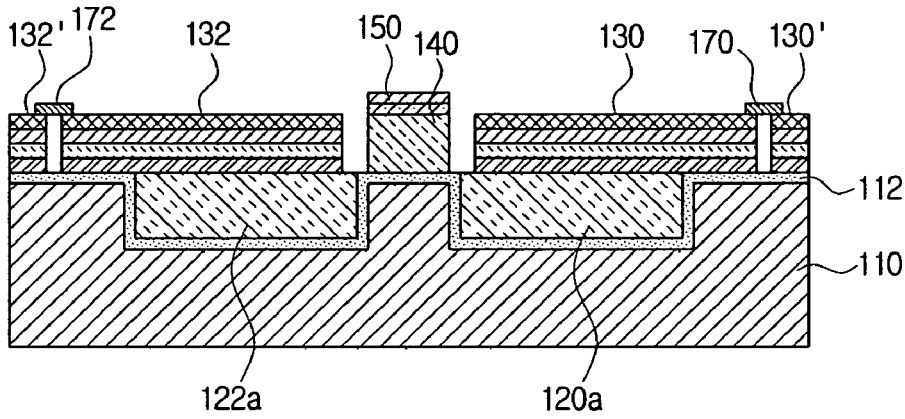
Figure 5F:
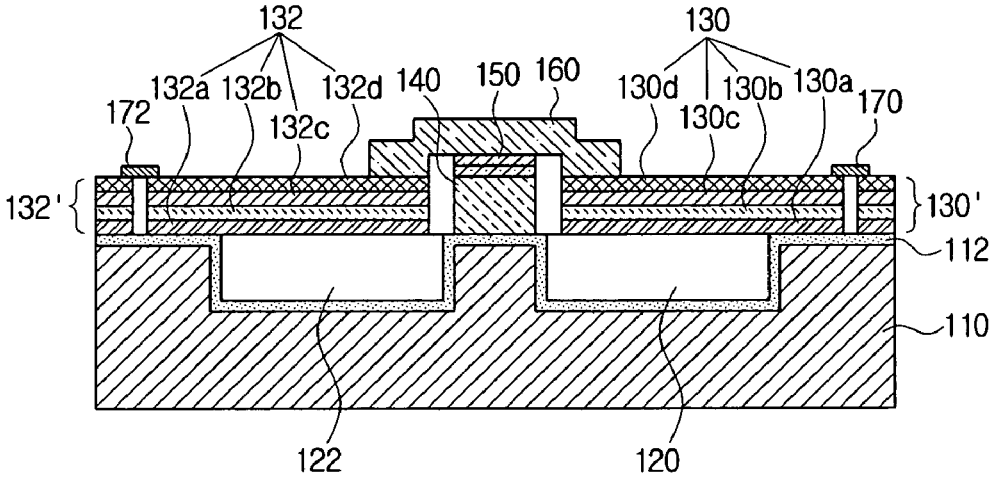

As shown in FIG. 5E, the third and the fourth sacrificial layers 200*a* and 200*b* are removed so that the first and the second actuators 130, 132, the first and the second fixing lines 140, 142, and the contact pad 150 are exposed. As shown in FIG. 5F, the first and the second sacrificial layers 120*a*, 122*a* are removed so that the first cavity and the second cavity 120, 122 are formed. Although not shown in FIG. 5E, the contact pad 150 is formed so that the opposite ends of the supporting layer 160, which crosses over the top portion of the contact pad 150, can be in contact with one end of each of the first membrane layer 130*d* and the second membrane layer 132*d*.

Accordingly, the first and the second actuators 130 and 132 generate piezoelectricity when power is applied through the first and the second electrode pads 180, 182, the driving lines 190, 192, the first and the second sub actuators 130', 132', the upper terminals 170, 172, and the lower terminals 171, 173. Then, the contact pad 150 is actuated downward so that the contact pad 150 becomes in contact with at least one of the first fixing line 140 and the second fixing line 142 and RF signals of a predetermined bandwidth are transmitted.

Figure 6A:
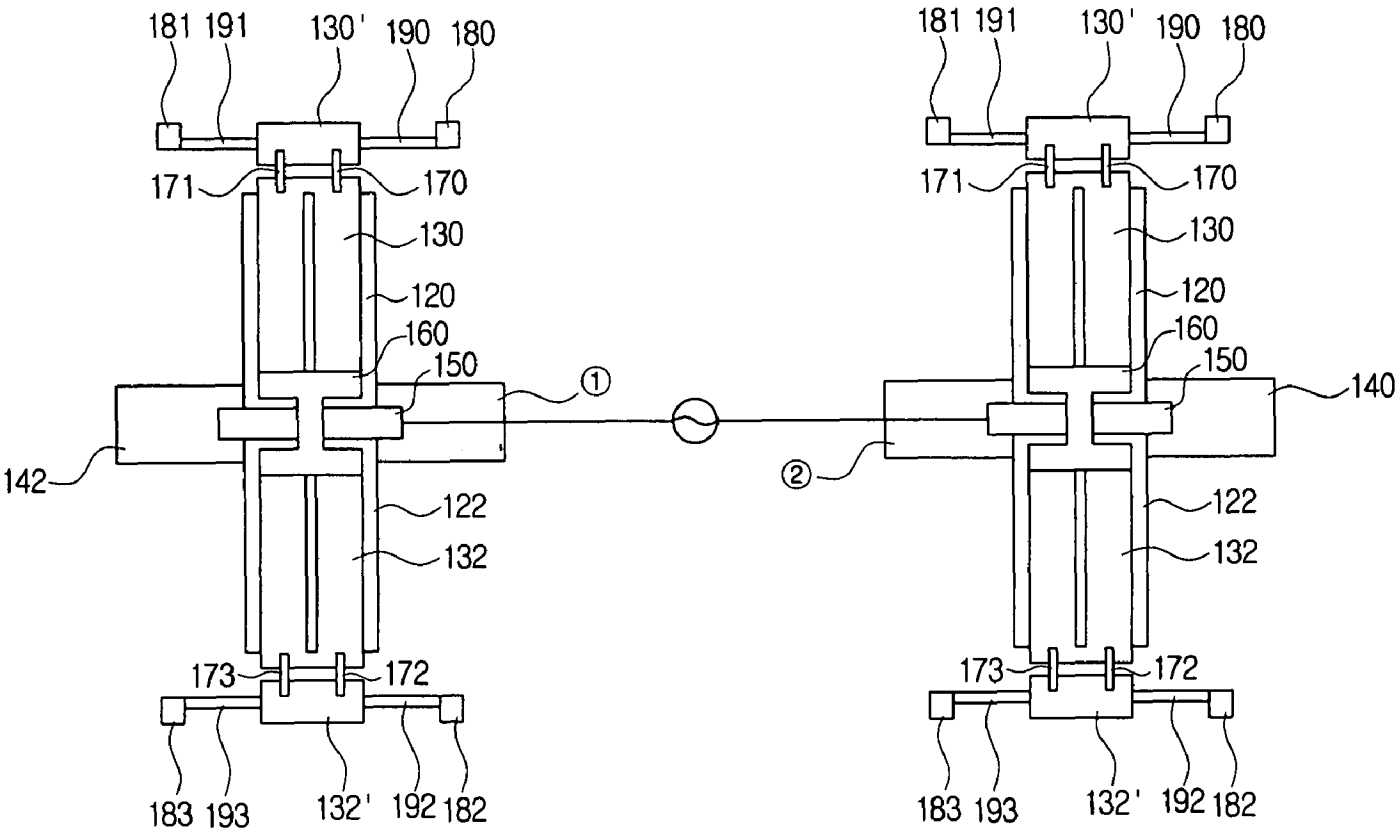
FIG. 6A is a view illustrating a configurable antenna employing a downward type MEMS switch illustrated in FIG. 1 according to a first exemplary embodiment of the present invention.
Figure 6B:
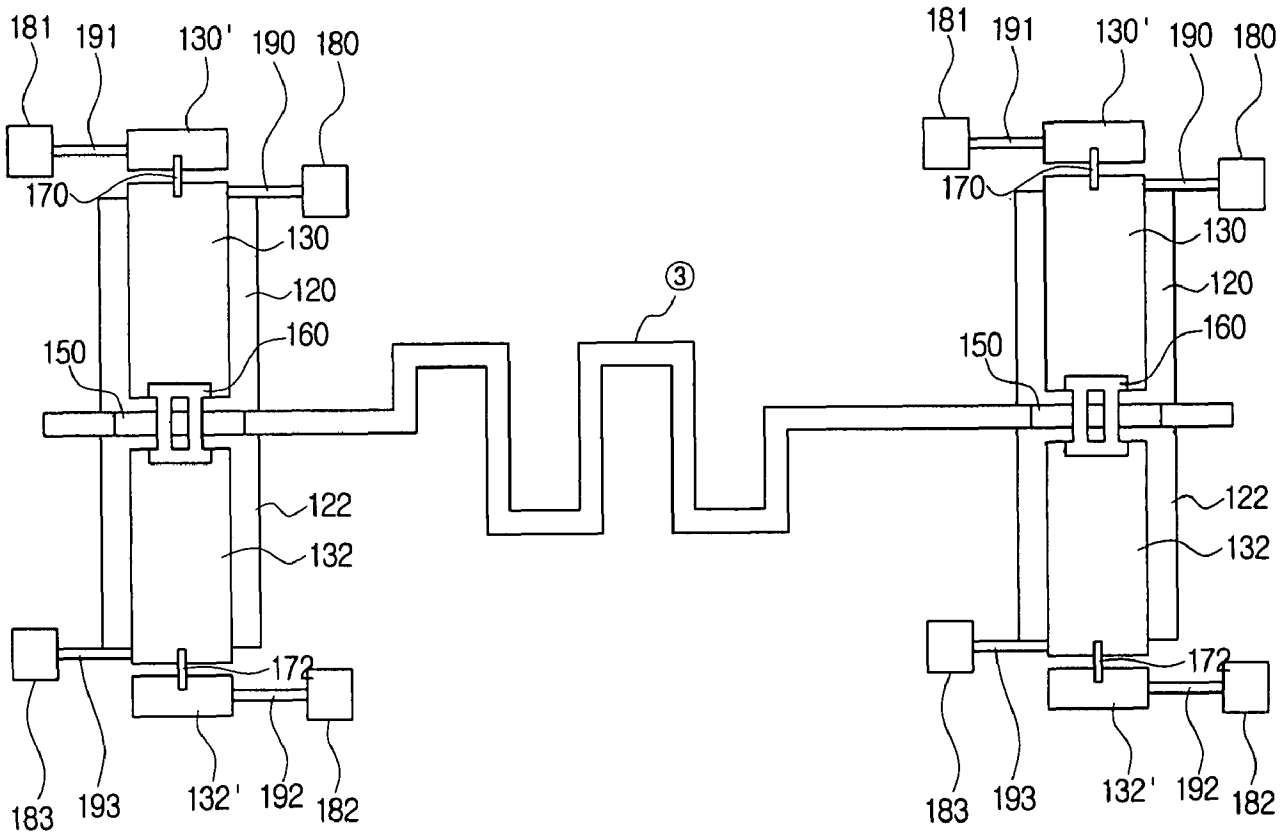
FIG. 6B is a view illustrating a configurable antenna employing a downward type MEMS switch illustrated in FIG. 2 according to a second embodiment of the present invention.

FIG. 6A shows a reconfigurable antenna employing a downward type MEMS switch of FIG. 1 according to the first exemplary embodiment of the present invention, and FIG. 6B shows a reconfigurable antenna employing a downward type MEMS switch of FIG. 2 according to the second exemplary embodiment of the present invention.

Referring to FIG. 6A, the reconfigurable antenna is a dipole antenna for multi band, and if the two downward type MEMS switches 100 are on, the first fixing line ① and the second fixing line ②, which are disposed between the two downward type MEMS switches 100, are electrically connected to each other so that RF signals of a first bandwidth are transmitted.

In FIG. 6B, the same elements as those of FIG. 6A are referred to the same reference numerals, but only the disposition of the supporting layer 160 or the driving lines 190, 191, 192, and 193 is changed. The reconfigurable antenna is a monopole antenna for multi band, and if the two downward type MEMS switches 100 are on, the fixing line ③, which is disposed between the two downward type MEMS switches 100, is electrically connected to each other so that RF signals of a second bandwidth are transmitted.

According to the aforementioned embodiments of the present invention, the first fixing line 140, the second fixing line 142 and the contact pad 150 share a layer as an antenna line to be finally packaged, and the contact pad 150, which will be in contact with the first fixing line 140 and the second fixing line 142, is fabricated at the final stage. Accordingly, a coupling phenomenon occurring between each element can decrease, and the MEMS switch can be driven by a low voltage.

If the downward type MEMS switch and a method for fabricating the same according to the present exemplary embodiments of the present invention are employed, the MEMS switch is fabricated by a piezoelectric scheme so as to be driven by a low voltage. Additionally, compatibility problems can be solved which occur when the antenna and the switch are fabricated so that the antenna and the switch can be fabricated on the same substrate. Therefore, it is possible to reduce the packaging cost and simultaneously miniaturize the MEMS switch.

The switch using piezoelectricity is employed so that an electro magnetic coupling phenomenon can be solved which occurs between the metal of the antenna line and the metal of the substrate. This can improve the performance of the MEMS switch.

Two symmetric actuators are employed so that an initial deformation can be in advance prevented, an accurate switching control can be performed, and reduction of driving force due to the symmetric structure can be prevented.

The contact pad, which is in contact with the antenna line, is formed after the actuator is fabricated so that a coupling phenomenon can be reduced.

Furthermore, the MEMS switch having the above effect is applied to the reconfigurable antenna for multi band so that the performance of both reconfigurable antenna and mobile devices employing the reconfigurable antenna can be enhanced.

While the invention has been shown and described with reference to certain embodiments thereof, it will be understood by those skilled in the art that various changes in form and details may be made therein without departing from the spirit and scope of the invention as defined by the appended claims.

What is claimed is:

1. A method of fabricating a downward type micro electro mechanical system (MEMS) switch comprising:

(a) forming a first cavity and a second cavity in a substrate;

(b) forming a first actuator on an upper portion of the first cavity and a second actuator on an upper portion of the second cavity;

(c) forming a first fixing line and a second fixing line on an upper surface of the substrate so that they are not overlapped with the first cavity and the second cavity; and (d) forming a contact pad which is spaced apart at a predetermined distance from surfaces of the first fixing line and the second fixing line but can be contacted with the first fixing line and the second fixing line when the first actuator and the second actuator are driven.

2. The method as claimed in claim 1, further comprising:

(e) forming a supporting layer which is spaced apart at a predetermined distance from a top surface of the contact pad to be connected to the first actuator and the second actuator.

3. The method as claimed in claim 1, wherein if power is applied, the contact pad is actuated downward by piezoelectricity generated from the first actuator and the second actuator so as to be connected to at least one of the first fixing line and the second fixing line.

4. The method as claimed in claim 1, wherein the first fixing line and the second fixing line are antenna signal lines of each different bandwidth.

5. The method as claimed in claim 1, wherein the contact pad is depressed at a certain area, and protrudes at opposite upper ends of the certain area so as to be connected to each of the first fixing line and the second fixing line.

6. The method as claimed in claim 1, wherein the operation (b) comprises:

(b1) forming a lower electrode on the substrate to cover the first cavity and the second cavity;

(b2) forming a piezo layer, comprising a piezo ceramic, on the lower electrode;

(b3) forming an upper electrode on the piezo layer; and (b4) forming a membrane layer on the upper electrode.

7. A downward type micro electro mechanical system (MEMS) switch comprising:

a substrate in which a first cavity and a second cavity are formed;

a first fixing line and a second fixing line which are formed on an upper surface of the substrate and which do not cross with the first cavity and the second cavity;

a contact pad which is spaced apart at a predetermined distance from surfaces of the first fixing line and the second fixing line; and a first actuator and a second actuator which are disposed on upper portions of the first cavity and the second cavity, respectively, and downward actuate the contact pad to be in contact with at least one of the first fixing line and the second fixing line when power is supplied.

8. The downward type MEMS switch as claimed in claim 7, further comprising:

a supporting layer which is spaced apart at a predetermined distance from a surface of the contact pad to be connected to the first actuator and the second actuator.

9. The downward type MEMS switch as claimed in claim 7, wherein the first fixing line and the second fixing line are antenna signal lines of different bandwidths.

10. The downward type MEMS switch as claimed in claim 7, wherein the contact pad is depressed at a certain area, and protrudes at opposite upper ends of the certain area so as to be connected to each of the first fixing line and the second fixing line.

11. The downward type MEMS switch as claimed in claim 7, wherein the first actuator and the second actuator each comprises:

a lower electrode which is disposed on the substrate to cover one of the first cavity and the second cavity;

a piezo layer which is disposed on the lower electrode and comprises a piezo ceramic;

an upper electrode which is disposed on the piezo layer; and a membrane layer which is disposed on the upper electrode.

12. The downward type MEMS switch as claimed in claim 7, wherein the contact pad is formed after the first actuator, the second actuator, the first fixing line, and the second fixing line are formed.

* * * * *